US006253811B1

(12) United States Patent
Slagh

(10) Patent No.: US 6,253,811 B1
(45) Date of Patent: Jul. 3, 2001

(54) FLUID-DISPENSING VALVE FOR A CONTAINER-FILLING APPARATUS

(75) Inventor: Bruce Slagh, Zeeland, MI (US)

(73) Assignee: Filler Specialties, Inc., Zealand, MI (US)

( * ) Notice: Subject to any disclaimer, the term of this patent is extended or adjusted under 35 U.S.C. 154(b) by 0 days.

(21) Appl. No.: 09/532,434

(22) Filed: Mar. 23, 2000

(51) Int. Cl.[7] ..... B65B 1/04

(52) U.S. Cl. ..... 141/383; 141/291; 141/292; 141/386

(58) Field of Search ..... 141/291, 292, 141/293, 294, 295, 296, 301, 302, 383, 386, 351, 352, 353, 354, 89, 40; 285/12, 906

(56) References Cited

U.S. PATENT DOCUMENTS

| | | | |
|---|---|---|---|
| 2,197,368 | * | 4/1940 | Minard . |
| 2,324,793 | * | 7/1943 | Minard . |
| 2,716,517 | * | 8/1955 | Tollberg . |
| 3,160,183 | * | 12/1964 | Franz . |
| 3,175,591 | * | 3/1965 | Manas . |
| 3,289,712 | * | 12/1966 | Smith . |
| 3,530,928 | | 9/1970 | Swinney . |
| 3,578,038 | | 5/1971 | Burford . |
| 3,756,290 | * | 9/1973 | Cleland et al. . |
| 3,871,425 | | 3/1975 | Fee et al. . |
| 3,892,264 | * | 7/1975 | Held . |
| 4,269,236 | | 5/1981 | Fogg . |
| 4,567,919 | | 2/1986 | Fogg et al. . |
| 4,960,296 | * | 10/1990 | Thelen et al. . |
| 5,037,141 | * | 8/1991 | Jardine . |
| 5,083,593 | | 1/1992 | Fogg . |
| 5,275,216 | | 1/1994 | Haedt . |
| 5,740,844 | * | 4/1998 | Miller ..... 141/90 |
| 5,865,221 | | 2/1999 | Ludwig et al. . |
| 5,975,159 | | 11/1999 | Persenaire et al. . |

FOREIGN PATENT DOCUMENTS

| | | |
|---|---|---|
| 3325338 A1 | 7/1983 | (DE) . |
| 0085758 | 8/1983 | (EP) . |

* cited by examiner

*Primary Examiner*—Steven O. Douglas
*Assistant Examiner*—Khoa Huynh
(74) *Attorney, Agent, or Firm*—Young & Basile, P.C.

(57) ABSTRACT

A fluid-dispensing valve for a container-filling apparatus comprises a vent tube having an axial mating surface; a nozzle positionable over and axially moveable in relation to the vent tube to define open and closed conditions of the fluid-dispensing valve, the nozzle including an axial mating surface; a biasing member for biasing the nozzle in a closed condition of the fluid-dispensing valve, the biasing member having a fluid passageway therethrough, and further including at least two axial mating surfaces, one axial mating surface axially abutting with an axial mating surface of each of the vent tube and nozzle to define an axially mated condition of the fluid-dispensing valve; and one or more members for maintaining the vent tube, nozzle, and biasing member in the axially mated condition of the fluid-dispensing valve.

11 Claims, 7 Drawing Sheets

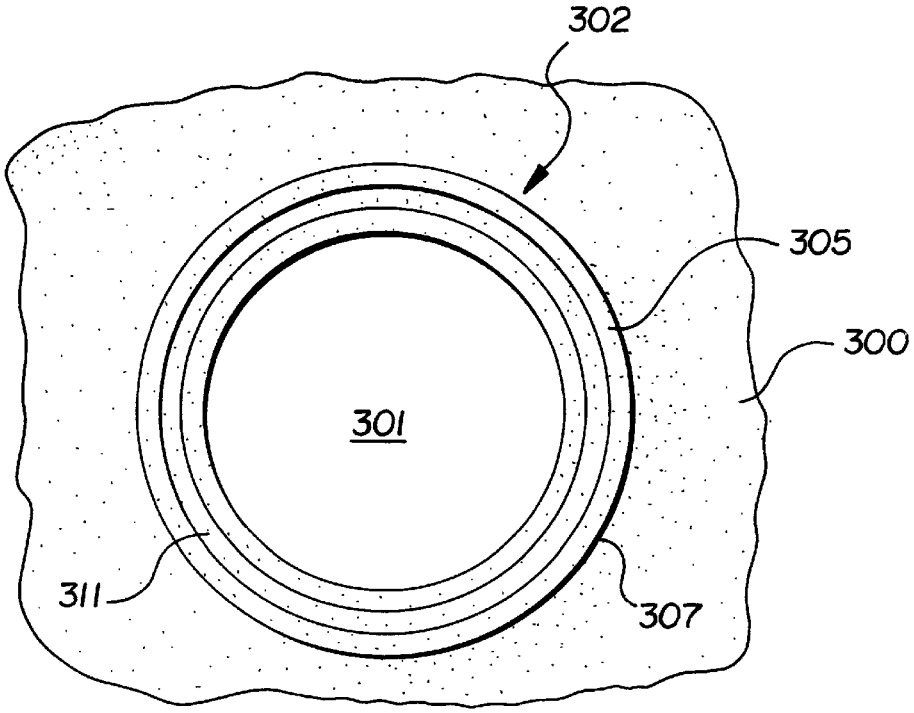
FIG-9
FIG-11
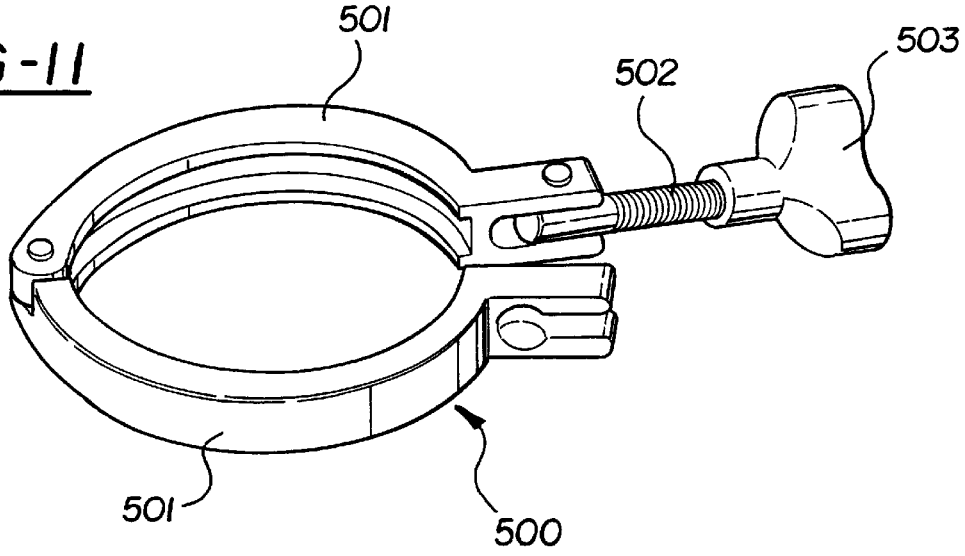

FLUID-DISPENSING VALVE FOR A CONTAINER-FILLING APPARATUS

FIELD OF THE INVENTION

The present invention pertains to container-filling apparatus, such as are employed for automatically filling containers with fluids, including consumables such as juice and dairy products. More particularly, the present invention concerns an improved fluid-dispensing valve for such container-filling apparatus, the valve being characterized by reduced assembled contact between the several fluid-contacting components thereof so as to minimize valve contamination by fluids dispensed through the valve.

BACKGROUND OF THE INVENTION

Automated fluid container-filling apparatus have long been known, and provide efficient and economical means for the mass packaging of various consumer goods, including bottled beverages such as juice and milk.

In the container-filling industry, one common automated container-filling apparatus is the rotary or turret type machine, which operates to precisely fill a series of bottles from a common fluid supply via a plurality of valves.

Conventional turret-type container-filling apparatus most generally comprise an elevated fluid storage receptacle, or bowl, for holding a desired fluid to be dispensed into containers. The fluid storage receptacle may be in fluid communication with a larger supply of the fluid to be dispensed, so that the same may be refilled with fluid as necessary. A plurality of fluid-outlet openings are provided through the bottom wall of the fluid storage receptacle, arranged equidistant from both each other and the central axis of the receptacle. Each such opening is surrounded by a generally cylindrical metal collar depending from the storage receptacle. A fluid-dispensing valve is secured to the collar of each fluid outlet opening by any suitable means.

Generally speaking, the container-filling cycle in turret type fluid-dispensing apparatus comprises elevating an empty container from a position below each dispensing valve until a portion of the valve has entered the container, opening a fluid supply passage to permit the fluid to accumulate in the container while simultaneously evacuating air from the container, lowering the container and closing the fluid supply passage to cease filling the container with fluid. Exemplary turret-type fluid-dispensing machine are disclosed in U.S. Pat. No. 3,578,038 and U.S. Pat. No. 3,892,264, both incorporated herein by reference in their entirety.

Several and varied valves are known for use in conjunction with the aforedescribed container-filling apparatus. One conventional fluid-dispensing valve, shown in FIGS. 1–4, incorporates a resilient, deformable bellows or diaphragm 10 to effect selective valve operation. The bellows-type valve most generally comprises a vent tube 20 and a nozzle 30 moveably interconnected by means of the bellows or diaphragm 10. Referring particularly to FIGS. 3 and 4, the vent tube 20 comprises an elongated, generally cylindrical rod, a portion of which extends upwardly into the fluid storage receptacle 40. An air passage (not shown) through the interior of the vent tube 10 functions to allow air to escape from the container being filled, and to evacuate that air to the storage receptacle 40. Exemplary vent tubes are disclosed in U.S. Pat. No. 3,871,425, U.S. Pat. No. 3,892,264, and U.S. Pat. No. 5,083,593, which references are incorporated herein in their entirety.

Still referring to FIGS. 3 and 4, the vent tube 20 extends through a radially expanded cylindrical portion 21 defining a fluid passageway 22 therethrough for a fluid to be dispensed by the valve. An annular rim or flange 23 projecting radially outward from this cylindrical portion 21 is of similar dimensions to a corresponding flange 41 on the collar 42 of the storage receptacle 40. A clamp 50 is receivable over and captures the flanges 23 and 41 therein to secure the vent tube 20 to the storage receptacle 40, as shown in FIG. 3. A gasket 60 between the cylindrical portion 21 and collar 42 improves sealing efficiency.

At its lower-most end the vent tube 20 terminates in tip comprising a fluid dispensing passageway 24 and an air inlet port communicating with the air passage (not shown). This portion of the vent tube 20 is dimensioned to be slidingly received in the generally cylindrical, valve-actuating nozzle 30. A sealing O-ring 70 positioned in an annular groove 25 in the tip of the vent tube seals the valve against leakage in the closed position thereof, and further restrains the nozzle 30 against axial disengagement with respect to the vent tube 20. (FIG. 3.) Axial movement of the nozzle 30 relative to the vent tube 20 defines the opened (FIG. 2) and closed (FIG. 1) positions of the valve. Particularly, the valve is in an opened position when the nozzle 30 moves axially upwards along the shaft of the vent tube 20 to expose the fluid dispensing passageway 24 and the air inlet port (not shown); when the nozzle 30 is positioned over the fluid dispensing passageway 24, conversely, the valve is in the closed position.

Referring again to FIG. 3, the diaphragm or bellows 10 defines a passageway 11 therethrough for communicating the fluid to be dispensed from the storage receptacle 40 to the nozzle 30. The diaphragm 10 is a unitary element of a suitably resilient, deformable plastic, such as rubber, to thereby permit axially upward movement of the nozzle 30 towards the open position of the valve, while also serving to bias the nozzle 30 axially downwards towards the closed position of the valve. As shown, the diaphragm 10 is characterized by a generally conical central portion 12, as well as oppositely arranged first 13 and second 14 cylindrical sections. The interior dimensions of the first 13 and second 14 sections are adapted to receive therein the cylindrical portion 21 of the vent tube 20, and a portion of the nozzle 30, respectively, in a friction-fit relationship to define the assembled valve.

Sterility in fluid-dispensing is particularly important in relation to packaging consumables, such as milk, orange juice, and other beverages. Milk, for instance, is a carbohydrate source for bacteria. Because fluids are communicated through the valves during dispensing, the various valve components are inevitably exposed to, and become covered with, the dispensed fluid. It is consequently necessary to undertake routine maintenance and cleaning of the valve components. Particularly as to the conventional valve of FIGS. 1–4, daily cleaning of valve components is frequently necessary as the fluid being dispensed tends to migrate between the longitudinal sections of the valve components where they are in frictional engagement, such as between the diaphragm 10 and each of the nozzle 30 and vent tube 20. (See FIG. 3.) Without such routine maintenance, bacteria would rapidly thrive in such fluid deposits and compromise sterility.

Consequently, it would be efficient and economical to provide a fluid-dispensing valve that reduced the aforementioned fluid contamination of valve components, as well as the consequent need for frequent, typically daily, valve cleaning.

SUMMARY OF THE DISCLOSURE

The present invention provides a fluid-dispensing valve for a container-filling apparatus, the valve comprising a vent tube having an axial mating surface, a nozzle positionable over and axially moveable in relation to the vent tube to define open and closed conditions of the fluid-dispensing valve, the nozzle including an axial mating surface, a biasing member for biasing the nozzle in a closed condition of the fluid-dispensing valve, the biasing member having a fluid passageway therethrough, and further including at least two axial mating surfaces, one axial mating surface axially abutting with an axial mating surface of each of the vent tube and nozzle to define an axially mated condition of the fluid-dispensing valve, and means for maintaining the vent tube, nozzle, and biasing member in the axially mated condition of the fluid-dispensing valve.

According to one feature of this invention, each of the vent tube, valve body, and biasing member include radial projections, and the means for maintaining the vent tube, nozzle, and biasing member in the axially mated condition comprise at least two clamps, one of said clamps being receivable over the radial projections of the vent tube and biasing member, and the other of said clamps being receivable over the radial projections of the nozzle and biasing member, to securely maintain the fluid-dispensing valve in the axially mated condition thereof. According to a further feature, these radial projections comprise annular shoulders on each of the vent tube, nozzle, and biasing member, and the clamps each include a circumferential channel for receiving a pair of axially confronting annular shoulders therein.

According to a further feature of this invention, a non-compressible, annular contact surface is axially superimposed on an inward surface of each annular shoulder of the biasing member, the annular contact surfaces each receivable within the circumferential groove of one of said clamps. Such contact surface may take the form of a metal or plastic annulus, for instance a ring or washer. The annulus provides a contact surface receivable within the annular channel of the clamp, thereby improving securement of the valve elements against axial separation.

According to still a further feature, the fluid-dispensing valve includes sealing means provided between abutting axial mating surfaces to improve sealing efficiency in the assembled valve. According to one feature of this invention, these sealing means comprise a raised annular member provided on one of a pair of abutting axial mating surfaces, and an annular groove provided on the other of said pair of abutting axial mating surfaces, wherein said raised annular member is receivable in said annular groove in sealing engagement.

BRIEF DESCRIPTION OF THE DRAWINGS

The inventive fluid-dispensing valve will be better understood with reference to the written description and the drawings, of which:

FIGS. 9 and 10 are elevational views of the axial mating surfaces of the biasing member of the present invention.

FIG. 11 is a perspective view of the securing means of the present invention, according to one exemplary embodiment.

DESCRIPTION OF THE ILLUSTRATED EMBODIMENT

Figure 2:
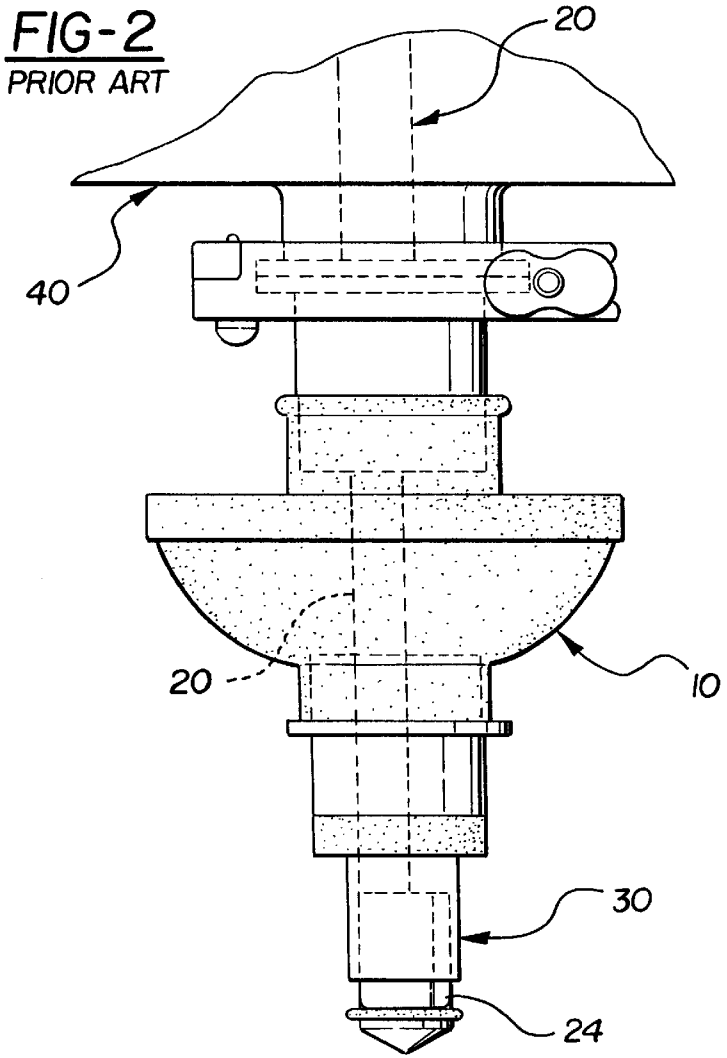
FIG-2 PRIOR ART
FIG. 2 comprises an elevational view of the fluid-dispensing valve of FIG. 1, the valve being shown in the open position thereof.
Figure 1:
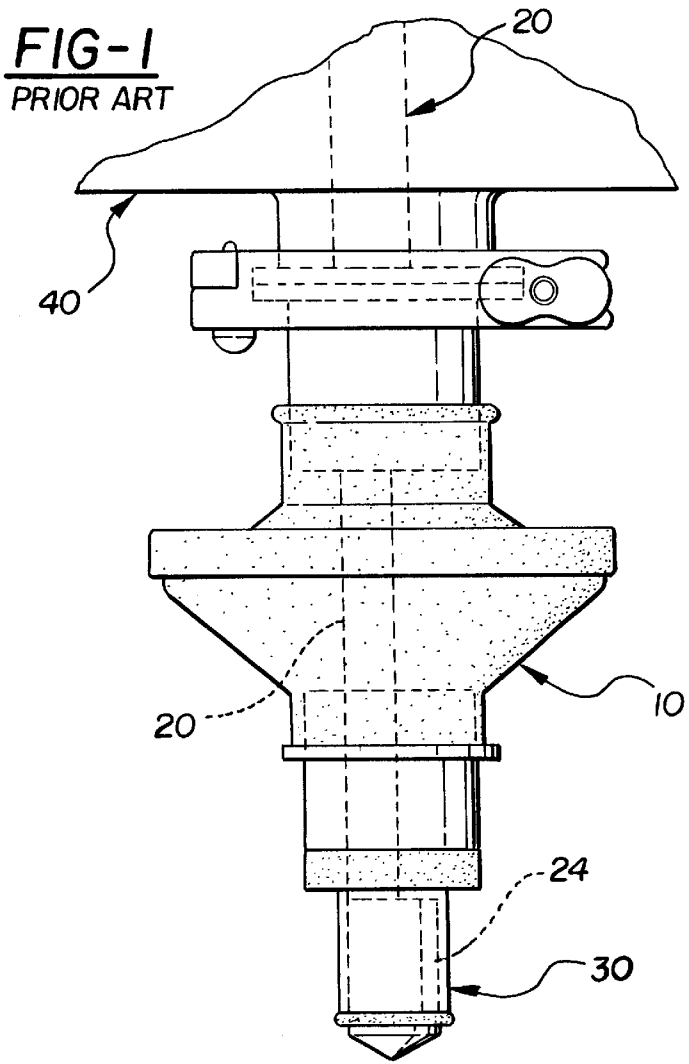
FIG-1 PRIOR ART
FIG. 1 comprises an elevational view of the prior art fluid-dispensing valve, the valve being shown in the closed position thereof.

Referring now to the drawings, wherein like numerals indicate like or corresponding parts, the present invention will be better understood. The present invention most generally comprises a fluid-dispensing valve, having application in conjunction with fluid-dispensing apparatus, for instance automated bottling apparatus. The present inventive valve is particularly well-suited, though not limited in application, to beverage or other fluid dispensing where sterility is a concern since, as explained further below, the inventive valve reduces contamination of valve components and facilitates valve cleaning, as compared to prior art valves.

Figure 5:
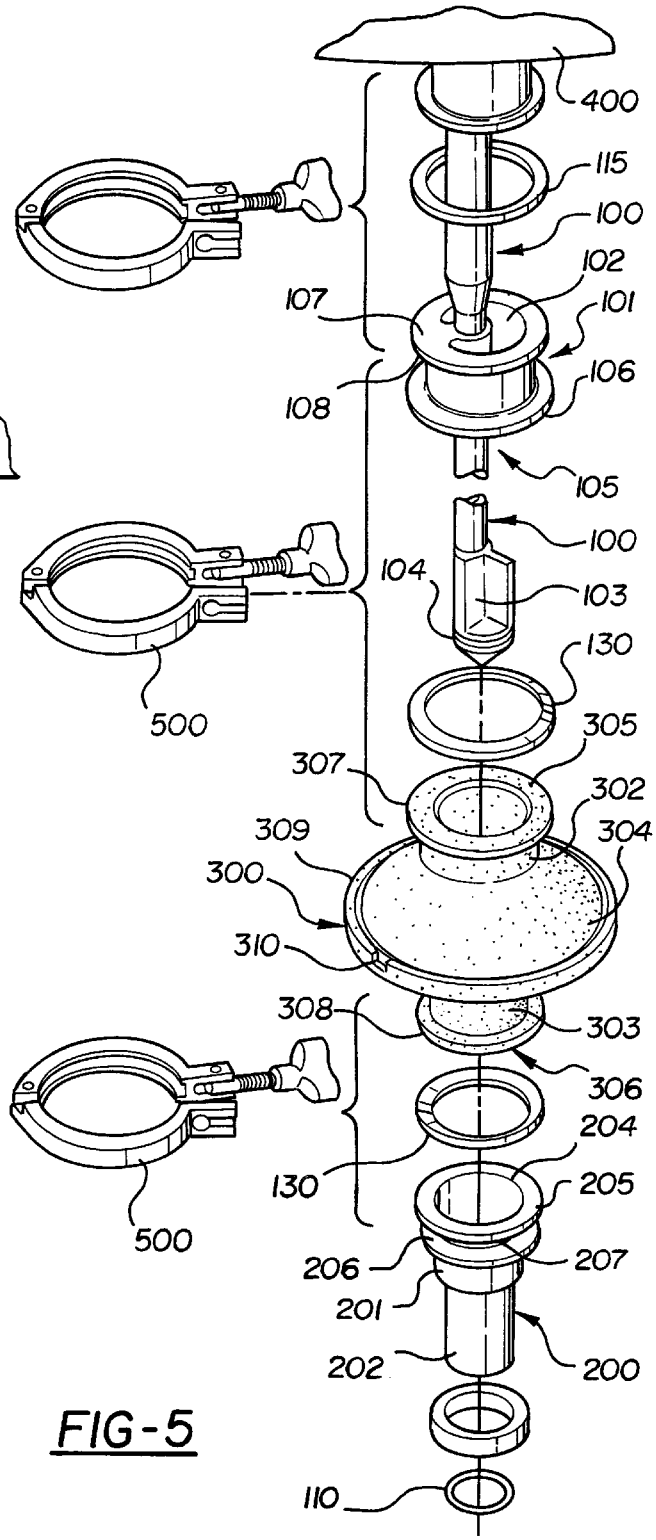
FIG. 5 is a exploded perspective view of the fluid-dispensing valve of the present invention.

Referring to FIG. 5, the inventive valve comprises most generally a vent tube 100 and a nozzle 200 moveably interrelated by a biasing member, such as the illustrated bellows or diaphragm 300.

Figure 6:
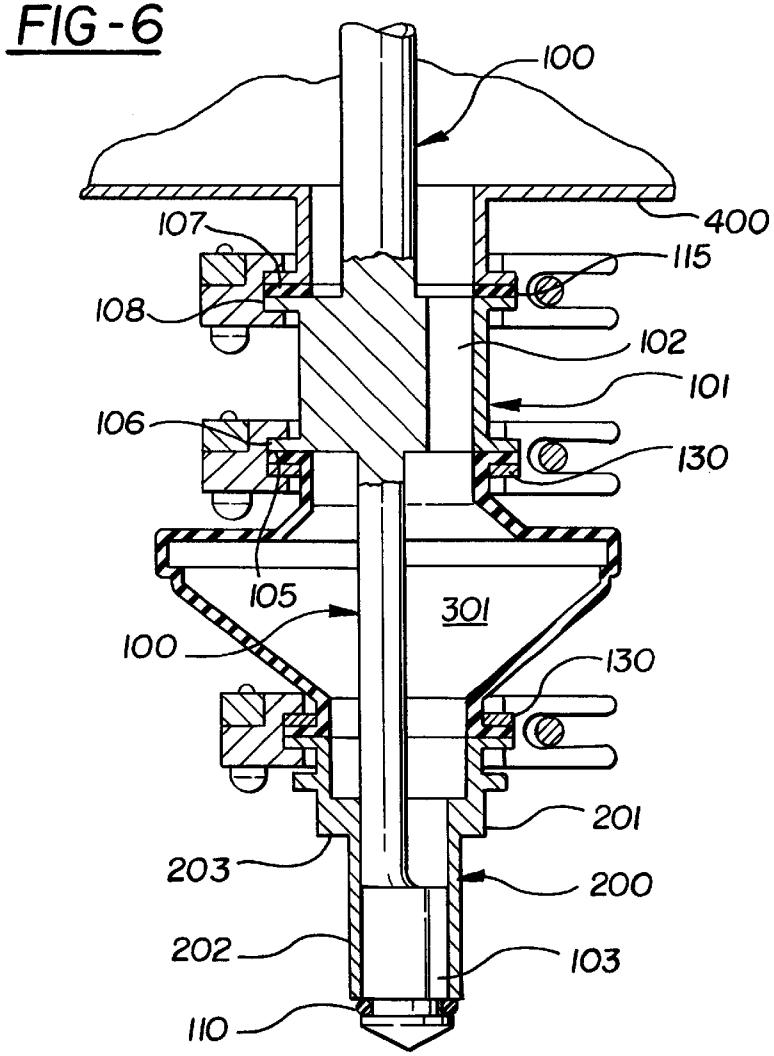
FIG. 6 is a cross-sectional view of the fluid-dispensing valve of the present invention, shown in an assembled condition.
Figure 3:
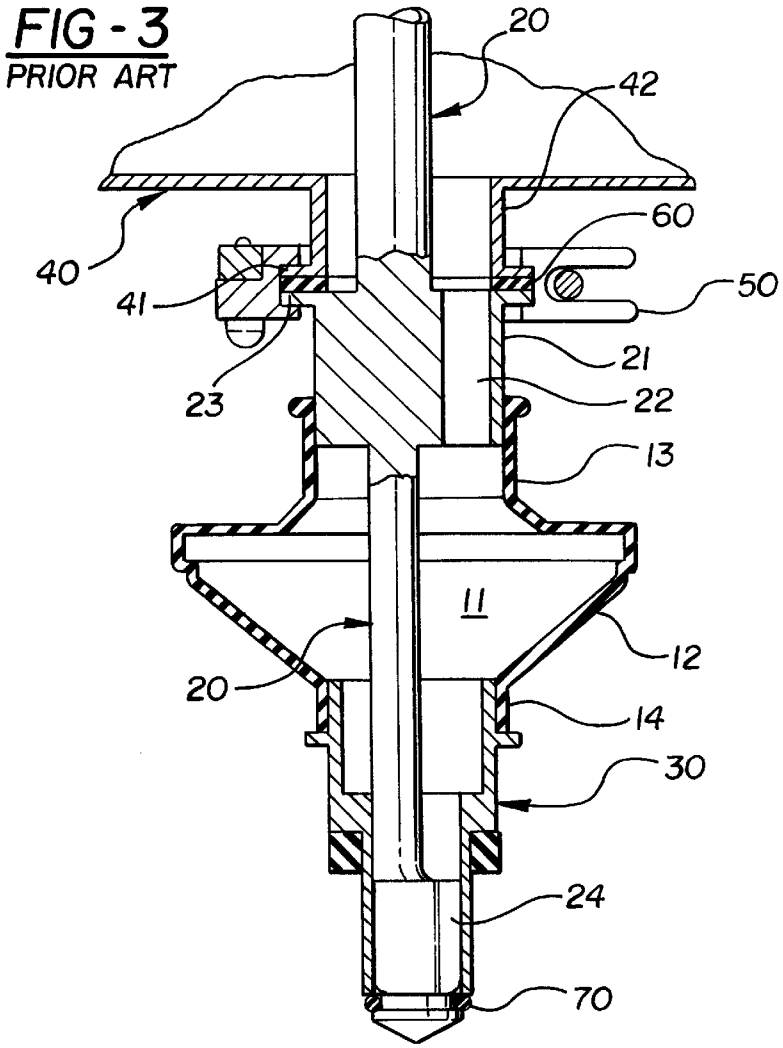
FIG-3 PRIOR ART
FIG. 3 is a detailed cross-sectional view of the prior art valve of FIG. 1, illustrating particularly the interrelation of the diaphragm with the nozzle and valve rod.
Figure 4:
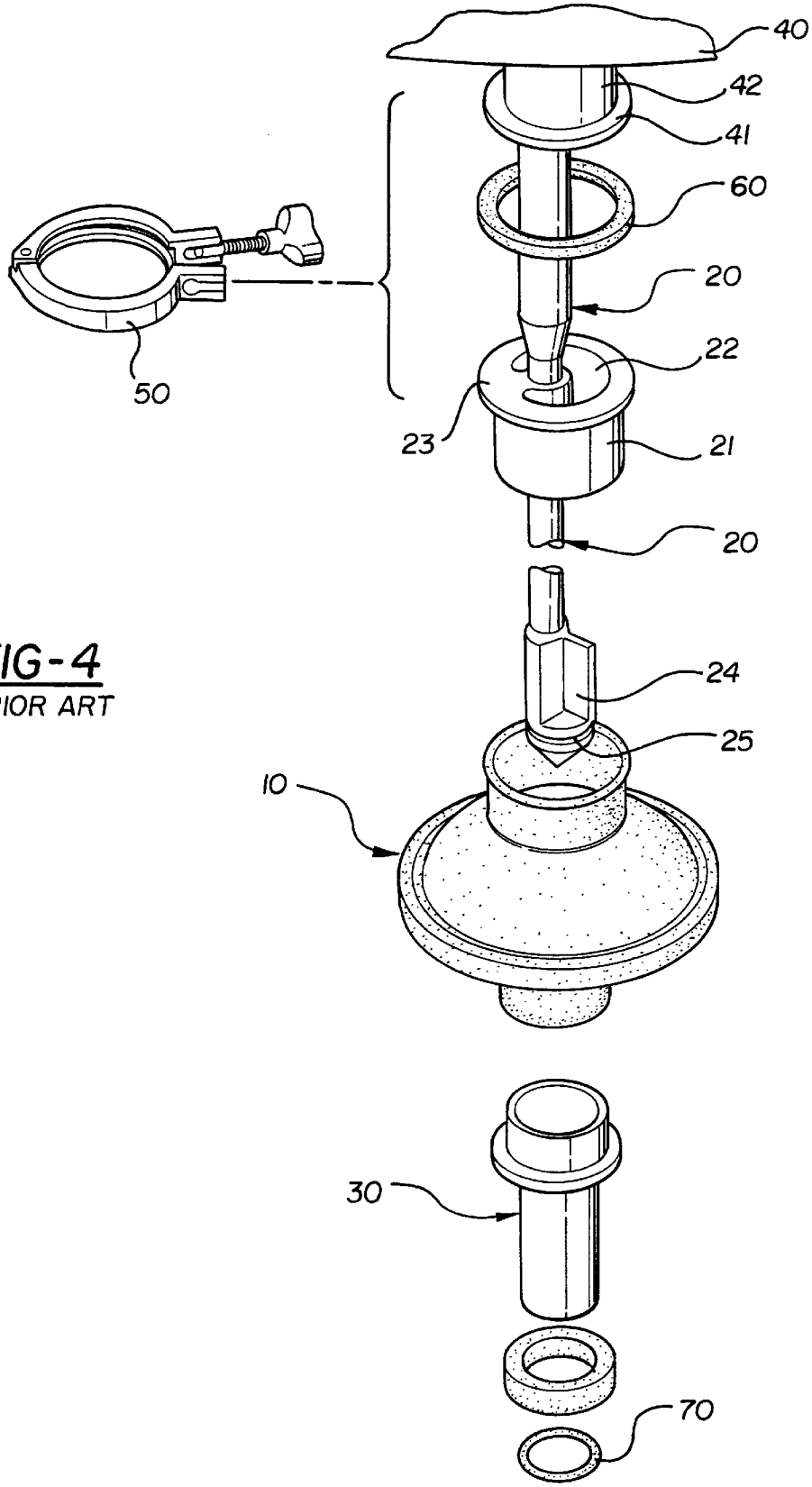
FIG-4 PRIOR ART
FIG. 4 comprises an exploded perspective view of the prior art fluid-dispensing valve.

Vent tube 100 is generally of a construction known in the art for fluid-dispensing valves of the operational type described herein. Exemplary construction of a vent tube for effecting fluid and air transfer may be found in U.S. Pat. No. 3,871,425, though it will be appreciated from the remainder of this disclosure that the particular configuration of the vent tube in respect of effecting air and fluid transfer is not critical to this invention, and may take any desired form. Particularly as illustrated, the vent tube 100 is as described hereinbefore in reference to FIGS. 1–4, with exceptions as noted in the remainder of this specification, and includes generally an elongate metal rod or tube defining an air passageway (not shown) therethrough for communicating air from the container to an air space in the storage vat during the fluid filling operation. The vent tube 100 is associated with a radially expanded, cylindrical portion 101 including a fluid passageway 102 therethrough for a fluid to be dispensed. The vent tube 100 extends through the cylindrical portion 101 and is preferably fixedly connected thereto in known fashion. Most preferably, the entire vent tube 100 and the cylindrical portion 101 comprise a unitary element formed from a suitable material, such as stainless steel. The lowermost end of the vent tube 100 terminates in a tip portion including a fluid dispensing passageway 103 and an air entry port communicating with the air passageway (not shown), as is known in the art. This portion of the vent tube 100 is dimensioned to be slidingly receivable in the generally cylindrical nozzle 200, as shown in FIG. 6. A polymeric O-ring 110 receivable in an annular recess 104 provided in the vent tube 100 at the tip thereof ensures a fluid-tight seal between the vent tube 100 and nozzle 200 in the closed condition of the valve, and further restrains the nozzle against axial separation from the vent tube.

Figure 7:
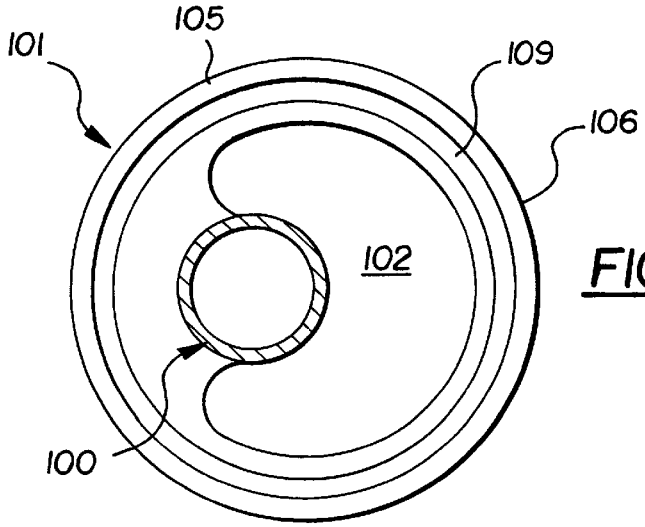
FIG. 7 is an elevational view of the axial mating surface of the vent tube of the present invention.

Referring now to FIGS. 5–7, at least the lower end of the cylindrical portion 101 terminates in an axial mating surface 105. This axial mating surface 105 most preferably includes a radial shoulder portion 106. The axial mating surface 105 facilitates mating attachment of the vent tube 100 with the biasing member 300, as explained hereinbelow. As illustrated, an upper axial mating surface 107 and shoulder portion 108 may also be provided to facilitate mating attachment of the vent tube 100 with a storage receptacle 400 including a corresponding axial mating surface and shoulder portion (FIGS. 5–6) as explained hereinabove with reference to FIGS. 1–4. A rubber gasket or O-ring 115 disposed between the opposing axial mating surfaces of the storage receptacle 400 and cylindrical portion 101 improves fluid sealing efficiency. However, the configuration of the storage receptacle and the means for securing the valve thereto are illustrative of one operational environment of the present invention and form no part thereof. Accordingly, other means known to those of skill in the art may be employed to secure the valve to a suitable storage receptacle.

Figure 8:
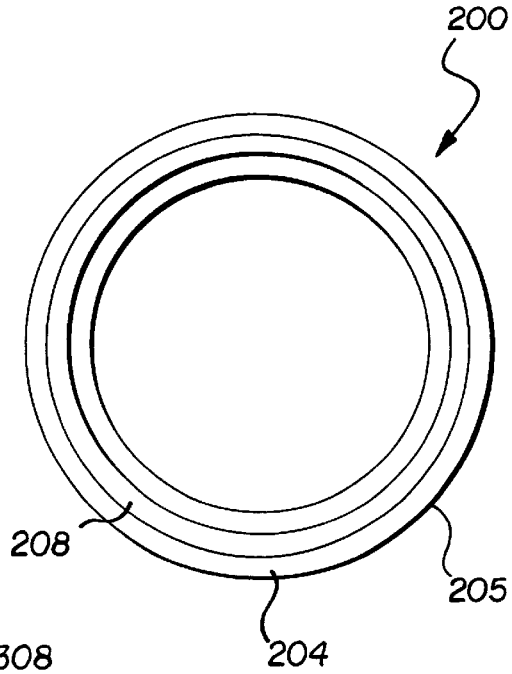
FIG. 8 is an elevational view of the axial mating surface of the nozzle of the present invention.

Turning now to FIGS. 5–6, and 8, the nozzle 200 is characterized by upper 201 and lower 202 cylindrical sections of differing diameter, these sections being distinguished by a radial stop shoulder 203 which acts as a stop surface for the mouth of a container to be filled with fluid. The lower cylindrical section 202 of the nozzle 200 is dimensioned to be receivable within the mouth of a container to be filled. Nozzle 200 further includes an upwardly-facing, axial mating surface 204 defined in part by the annular shoulder 205, and a second annular shoulder 206 positioned below the annular shoulder 205 to define an annular channel 206 therebetween.

Disposed between cylindrical section 101 and nozzle 200 is a biasing member 300, shown in FIGS. 5–6, and 9–10. Biasing member 300 is preferably formed of a suitably resilient, deformable material, preferably a polymer, and more preferably rubber. The biasing member 300 is sufficiently deformable to permit axial upwards movement of the nozzle 200 relative to the vent tube 100 to open the valve, while being sufficiently resilient to bias the nozzle 200 axially downwards to close the valve. The biasing member 300 is most preferably of unitary construction, with imperforate walls defining a fluid passageway 301 between opposite open ends thereof for communicating fluid between a fluid storage receptacle 400 and the fluid dispensing passageway 103 of the vent tube 100. (FIG. 6.) The biasing member includes generally cylindrical upper 302 and lower 303 portions, and a radially expanded central portion 304 tapering inwardly downwards. (FIG. 5.) Of course, the precise shape of the biasing member 300 is not critical to this invention, and those of skill will appreciate that the biasing member 300 may take any desired form consistent with the limitations of this disclosure and the operational requirements of the fluid-dispensing valve.

Figure 10:
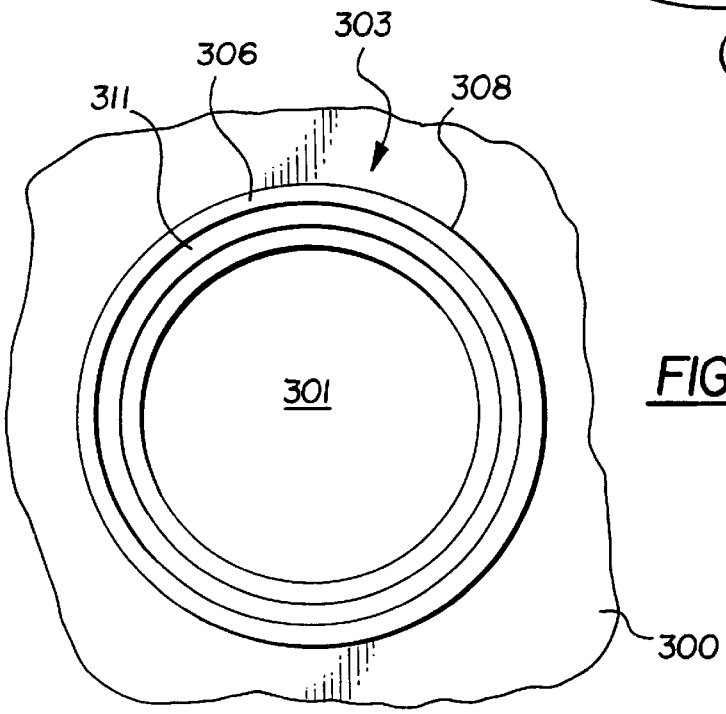

Referring particularly to FIGS. 9 and 10, the upper 302 and lower 303 portions of the biasing member 300 each terminate in axial mating surfaces 305 and 306 facing, respectively, upwardly and downwardly. Radial shoulder portions 307 and 308 are preferably formed integrally with the biasing member, and define a portion of the axial mating surfaces 305 and 306, respectively. As shown particularly in FIG. 5, the central portion 304 may further include a raised annular rim 309 including one or more apertures 310 therein for collecting and draining away condensation, such as tends to collect on the exterior surface of the fluid storage vat in some fluid-dispensing applications. However, this feature may be incorporated into the biasing member 300 as desired, it comprising no part of the present invention.

Referring now to FIGS. 5–6, the interrelation of the above-described components will be better understood. Particularly, the confronting axial mating surfaces 105 and 305 are brought into abutting contact so that the vent tube 100 extends through the fluid passageway 301 of the biasing member 300; and the nozzle 200 is received over the vent tube 100 to bring the confronting axial mating surfaces 204 and 306 into abutting contact.

In order to ensure fluid-tight sealing engagement between the biasing member 300 and each of the vent tube 100 and nozzle 200, respectively, sealing means are preferably provided between the confronting pairs of axial mating surfaces. Such sealing means may take the form of a gasket, O-ring, etc. It is most preferred that these sealing means take the form of a raised, annular sealing member 311 formed integrally with each of the axial mating surfaces 305 and 306, and that the corresponding axial mating surfaces 105 and 204, respectively, include correspondingly shaped annular recesses 109 and 208 adapted to receive an annular sealing member 311 therein in sealing engagement. (FIGS. 7–10.)

Figure 12:
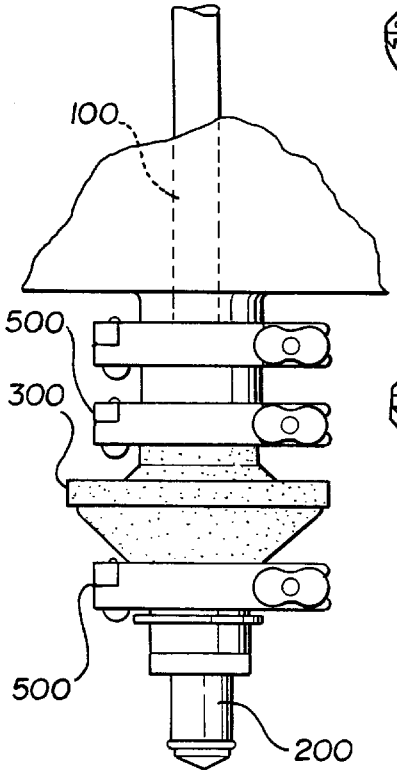
FIG. 12 is an elevational view of the fluid-dispensing valve of the present invention in an assembled condition.

It will be appreciated from the foregoing description that the axially mated condition of the valve—that is, the condition wherein the axial mating surfaces of the nozzle and vent tube are in abutting contact with the corresponding axial mating surfaces of the biasing member—does not by itself prevent axial separation of the valve components since, unlike the prior art, the present invention does away with the longitudinal, friction-fit engagement between these components. Consequently, means are preferably provided for maintaining the respective valve elements (valve rod 100, nozzle 120, and biasing member 300) in their above-described axially mated condition. Such means may take numerous forms, including most generally any device operative to maintain the confronting axial mating surfaces in an axially mated, fluid-sealed condition. It is preferred that these means be external of the valve, so as to facilitate easy valve maintenance and ensure effective sealing engagement between the valve components. It is most preferred that these means permit selective disassembly of the valve, thereby facilitating easy maintenance of the valve components. In the illustrated embodiment of this invention, these means comprise clamps 500 operative to restrain the mated valve components against axial separation. As shown in FIG. 11, each clamp comprises two identical, pivotally interconnected, semi-circular halves 501. One free end of the clamp 500 terminates in a radial projection to which is pivotally connected a locking member 503 comprising a threaded stem 502 and correspondingly threaded locking nut 503. The interior surface of each clamp 500 is characterized by a circumferential recess 504 dimensioned to receive a pair of the radial shoulders 308, 205 or 307, 106, respectively, in the assembled condition of the valve, and to so maintain the axially confronting valve components in a tight, sealing engagement. (FIGS. 6 and 12.)

In order to avoid wear to the biasing member 300, and to improve axial mating between the biasing member and the other valve components, it is most preferred that a non-deformable contact surface be provided between each shoulder 307, 308 of the biasing member 300 and the clamp 500. (FIG. 6.) The radial dimensions of each such contact surface is preferably sufficient to provide a contact surface for a clamp 500. As shown, such contact surface may take the form of a metal or plastic annulus 130, for instance a ring or washer, dimensioned to be receivable over an upper 302 or lower 303 portion of the biasing member 300, and to cover a surface of the shoulder 307, 308 opposite the axial mating surface.

Figure 13:
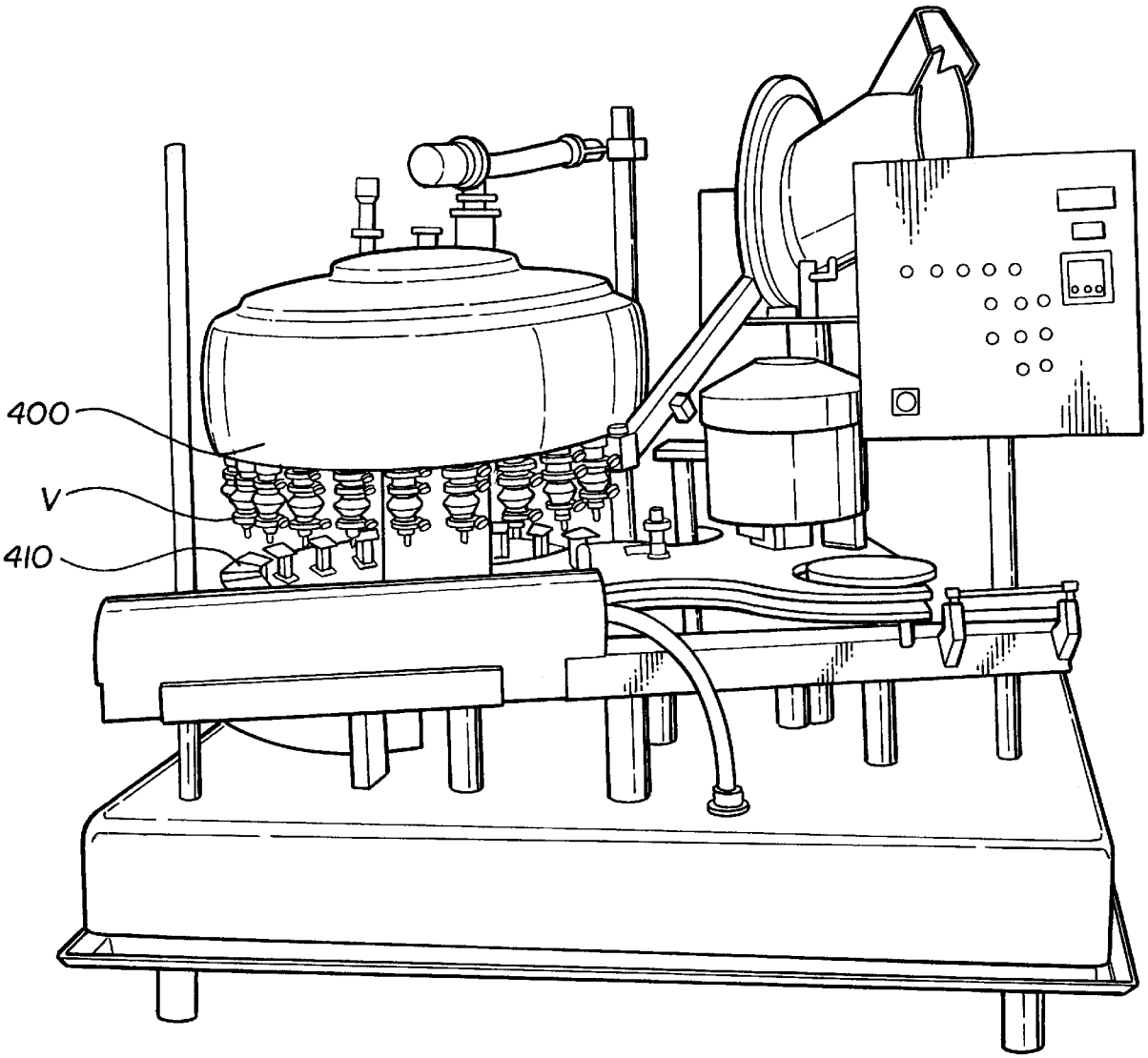
FIG. 13 depicts the fluid-dispensing valve of the present invention in one possible operating environment.

In effecting the fluid-dispensing operation generally, the valve of this invention is comparable in principle to the prior art valve described above in connection with FIGS. 1–4, and further described in U.S. Pat. No. 3,871,425. Referring particularly to FIG. 13, exemplary operation of the invention in conjunction with a turret-type container-filling apparatus—one possible operational environment—is described.

Below the fluid storage receptacle 400 is provided a plurality of container-supporting platforms 410; one platform is positioned directly beneath each fluid-dispensing valve V in a circular path about the storage receptacle 400.

During operation of the container-filling apparatus, containers (not shown) to be filled with a desired liquid are continuously fed onto the container-supporting platforms, which platforms revolve synchronously with the fluid storage receptacle 400. As the platforms revolve in their circular path, the mouth of each container is brought into contact with the nozzle 200 of the valve, for instance by cam-actuated upward movement of the container-supporting platforms. Coaction of the nozzle 200 and container urges the nozzle upwards against the biasing force of the diaphragm, which causes the fluid supply passage around the vent tube 100 to open, and fluid to be dispensed into the container. Simultaneously, air from the containers displaced by the fluid is evacuated upwardly into the storage receptacle 400 through the air passageway (not shown) in the vent tube 100. The filled container is then lowered relative to the valve and the nozzle 200 is urged axially downwards by the biasing member 300 to close the fluid supply passage and seal the valve against further fluid flow.

It will be appreciated from the foregoing disclosure that my invention significantly reduces contacting surfaces between the various valve components in the assembled condition of the valve and, consequently, that the contamination of these components by migrating fluids is reduced. In practice, it has been found that my invention requires significantly less maintenance than prior art fluid-dispensing valves, and that cleaning can be effected without having to either remove the valve from the fluid-dispensing apparatus or disassemble the valve.

It will be understood from the foregoing examples of the invention that a particular fluid-dispensing valve is illustrated, and variations may be effected as necessary in the employment of this invention in any given fluid-dispensing apparatus. Such variations and modifications can be made by those skilled in the art without undue experimentation now that I have disclosed my invention in the embodiment above. Nothing in the foregoing description is intended to limit the invention beyond the scope of the following claims.

The invention in which an exclusive property or privilege is claimed is defined as follows:

1. A fluid-dispensing valve for a container-filling apparatus, the valve comprising:

a vent tube having a generally downwardly facing axial mating surface transverse of a longitudinal axis of the vent tube;

a nozzle positionable over and axially moveable in relation to said vent tube to define open and closed conditions of the fluid-dispensing valve, said nozzle including a generally upwardly facing axial mating surface transverse of a longitudinal axis of the nozzle;

a biasing member for biasing the nozzle in a closed condition of the fluid-dispensing valve, said biasing member having a fluid passageway therethrough, and further including at least two axial mating surfaces transverse of the fluid passageway, one generally upwardly facing axial mating surface axially abutting with said axial mating surface of said vent tube and one generally downwardly facing axial mating surface axially abutting with said axial mating surface of said nozzle to define an axially mated condition of the fluid-dispensing valve, characterized in that said axial mating surfaces of the nozzle, biasing member and vent tube are not in longitudinal, friction-fit engagement; and means for maintaining said vent tube, nozzle, and biasing member in the axially mated condition of the fluid-dispensing valve.

2. The fluid-dispensing valve of claim 1, wherein each of said vent tube, nozzle, and biasing member include radial projections, and said means for maintaining said vent tube, nozzle, and biasing member in the axially mated condition comprise at least two clamps, one of said clamps being receivable over said radial projections of said vent tube and biasing member, and the other of said clamps being receivable over said radial projections of said nozzle and biasing member, to thereby securely maintain the fluid-dispensing valve in the axially mated condition thereof.

3. The fluid-dispensing valve of claim 2, wherein said radial projections comprise annular shoulders on each of said nozzle, nozzle, and biasing member, and said clamps each include a circumferential channel for receiving said annular shoulders therein.

4. The fluid-dispensing valve of claim 3, further comprising a non-compressible, annular contact surface axially superimposed on each said annular shoulder of said biasing member, said annular contact surfaces each receivable within said circumferential channel of one of said clamps.

5. The fluid-dispensing valve of claim 1, further comprising sealing means provided between abutting axial mating surfaces.

6. The fluid-dispensing valve of claim 5, wherein said sealing means comprise a raised annular member provided on one of a pair of abutting axial mating surfaces, and an annular groove provided on the other of said pair of abutting axial mating surfaces, wherein said raised annular member is receivable in said annular groove in sealing engagement.

7. A fluid-dispensing valve for a container-filling apparatus, the valve comprising:

a resilient diaphragm having first and second opposite ends and defining a fluid passageway therethrough, said first and second ends defining, respectively, generally upwardly and downwardly facing axial mating surfaces of the diaphragm transverse of the fluid passageway;

a vent tube extending through the fluid passageway of the diaphragm, said vent tube including a generally downwardly facing axial mating surface transverse of a longitudinal axis of the vent tube for abutting contact with said upwardly facing axial mating surface of said diaphragm;

a nozzle positionable over and axially moveable in relation to said vent tube to define open and closed positions of the fluid-dispensing valve, said nozzle including a generally upwardly facing axial mating surface transverse of a longitudinal axis of the nozzle for abutting contact with said generally downwardly facing axial mating surface of said diaphragm;

wherein, when said axial mating surfaces of said nozzle and vent tube are each in abutting contact with said upwardly and downwardly facing axial mating surfaces of said diaphragm, the fluid-dispensing valve is in an axially mated condition thereof, characterized in that said axial mating surfaces of the nozzle, biasing member and vent tube are not in longitudinal, friction-fit engagement; and restraints external of the fluid-dispensing valve for maintaining the valve in said axially mated condition thereof.

8. The fluid-dispensing valve of claim 7, wherein each of said vent tube, nozzle, and biasing member include radial projections, and said restraints comprise at least two clamps, one of said clamps being receivable over said radial projections of said vent tube and biasing member, and the other of said clamps being receivable over said radial projections of said nozzle and biasing member, to thereby securely maintain the fluid-dispensing valve in the axially mated condition thereof.

9. The fluid-dispensing valve of claim 8, wherein said radial projections comprise annular shoulders on each of said nozzle, nozzle, and biasing member, and said clamps each include a circumferential channel for receiving said annular shoulders therein.

10. The fluid-dispensing valve of claim 9, further comprising a non-compressible, annular contact surface axially superimposed on each said annular shoulder of said biasing member, said annular contact surfaces each receivable within one of said clamps.

11. The fluid-dispensing valve of claim 7, further comprising a raised annular member provided on one of a pair of abutting axial mating surfaces, and an annular groove provided on the other of said pair of abutting axial mating surfaces, wherein said raised annular member is receivable in said annular groove in sealing engagement.

* * * * *

UNITED STATES PATENT AND TRADEMARK OFFICE

CERTIFICATE OF CORRECTION

PATENT NO. : 6,253,811 B1
DATED : July 3, 2001
INVENTOR(S) : Slagh

It is certified that error appears in the above-identified patent and that said Letters Patent is hereby corrected as shown below:

Column 8,
Line 11, delete "nozzle", first occurrence, and insert -- vent tube --;
Line 53, delete "biasing member" and insert -- diaphragm --;
Line 60, delete "biasing member" and insert -- diaphragm --;
Line 63, delete "biasing member" and insert -- diaphragm --;
Line 65, delete "biasing member" and insert -- diaphragm --;

Column 9,
Line 1, delete "biasing member" and insert -- diaphragm --;
Line 1, delete "nozzle", first occurrence, and insert -- vent tube --;
Line 6, delete "biasing member" and insert -- diaphragm --;

Signed and Sealed this

Fourth Day of December, 2001

*Attest:*

Nicholas P. Godici

*Attesting Officer*

NICHOLAS P. GODICI
*Acting Director of the United States Patent and Trademark Office*